US005738350A

United States Patent [19]

Lai

[11] Patent Number: 5,738,350

[45] Date of Patent: Apr. 14, 1998

[54] GAMING BALL

[76] Inventor: Cheng Lai, 11858 Preston Trails, Northridge, Calif. 91326

[21] Appl. No.: 754,394

[22] Filed: Nov. 21, 1996

[51] Int. Cl.[6] ..... A63B 71/00

[52] U.S. Cl. ..... 273/139; 273/144 R; 273/144 B

[58] Field of Search ..... 473/168, 169, 473/569, 570; 273/138.1, 139, 144 R, 144 A, 144 B

[56] References Cited

U.S. PATENT DOCUMENTS 2,616,368 11/1952 Hochman ..... 101/333

5,088,737 2/1992 Frank et al. ..... 273/138

5,370,389 12/1994 Reising ..... 273/35

*Primary Examiner*—Mark S. Graham

[57] ABSTRACT

A gaming ball having a weight in the form of a seam and a bar code printed along the seam is provided for use in an air controlled lottery machine for quickly aligning and scanning the bar code as the ball rests on a support surface. The seam extends around the entire circumference of the inner surface of the ball to provide a weight which is more than ⅛ of the ball.

6 Claims, 1 Drawing Sheet

GAMING BALL

BACKGROUND OF THE INVENTION

Over the last ten years, the use of lottery games and related games using ping pong balls has increased tremendously. In a typical lottery dispenser, balls are pneumatically mixed and dispensed to a caller for reading the number on the outside of the ball. More recent lottery dispensers have other optical-electrical reading units which read coded information from the surface of the ball.

A typical lottery machine of the latter type is described in Frank U.S. Pat. No. 5,088,737. Bar code scanning light pens located adjacent the settlement pockets and in close proximity to the rotating randomly selected bails read the bar codes and transmit electronic signals to a computer in the machine which compares the randomly generated number to the player's previously selected number to determine if a successful match has occurred, in which case, a redeemable ticket is dispensed. The type of lottery machine disclosed in Frank and those type of ball handling machines used to play Keno and other similar games require machine readable balls.

The balls used in these types of machines are used everyday, all day and sometimes all night such as for use in casinos. The balls are rubbed to the point that the bar code is removed due to overuse. Replacement of the balls is expensive due to the cost of purchasing balls having a particular bar code for each ball that will interact with the machine and correspond to the other balls.

In the past, various means have been used to attach the bar code to the ball. As described in Frank, there are technical difficulties in printing narrow lines over the entire circumference of spherical surfaces. Frank teaches that a bar code could be printed on an adhesive medium which are then applied to the ball. Unfortunately, the adhesive medium becomes loose overtime and falls off sometimes damaging the machine.

SUMMARY OF THE INVENTION

It is an object of the present invention to provide a lottery ball having a seam formed along the inside circumference of the ball and a bar code printed along the seam on the outside surface of the ball so the seam acts as an alignment weight for positioning the ball on a support device for scanning.

It is a further object of the present invention to provide a lottery ball having an inner seam which weighs more than ⅛ of the ball and provides a leveling means for aligning the ball on a support surface for scanning.

It is yet a further object of the present invention to provide a, lottery ball having an inner seam and a bar code printed along the seam on the outside surface of the ball above a lottery ball number and identification means for making the number visible.

A lottery ball is provided having a weighted seam used for aligning the ball on a support surface of an air controlled lottery machine for quick scanning and dispensing a bar code is printed on the outside surface of the ball along the seam for quick scanning.

DETAILED DESCRIPTION OF THE PREFERRED EMBODIMENTS

Figure 1:
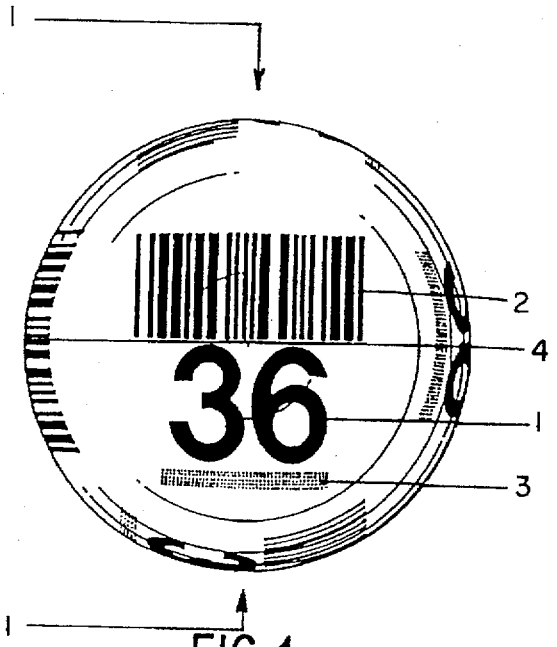
FIG. 1 illustrates the gaming ball of the present invention.

The present invention gaming ball is illustrated in FIG. 1. The gaming ball is made from materials used to make ping pong balls. The ball is illustrated having a number 1, a bar code 2 and an indicator pattern 3 positioned directly under the number to make the number clearly visible to the players. The gaming ball is used in a lottery or keno machine which use a vacuum blower to pull balls one at a time to a support surface where a scanner reads the bar code printed on the gaming ball.

Figure 2:
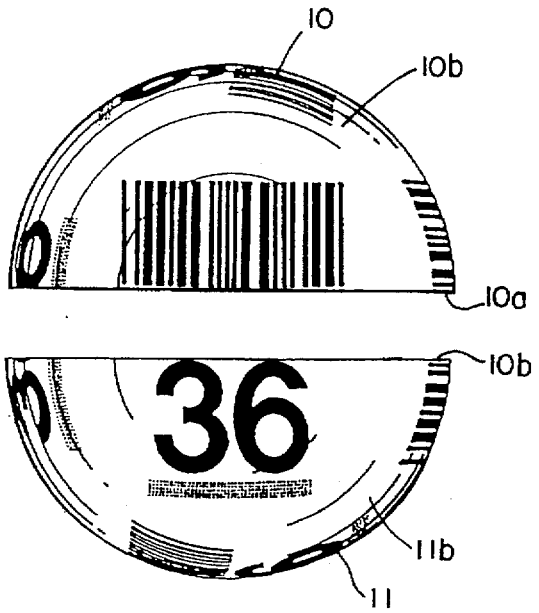
FIG. 2 shows the present invention gaming ball before it has been assembled.
Figure 3:
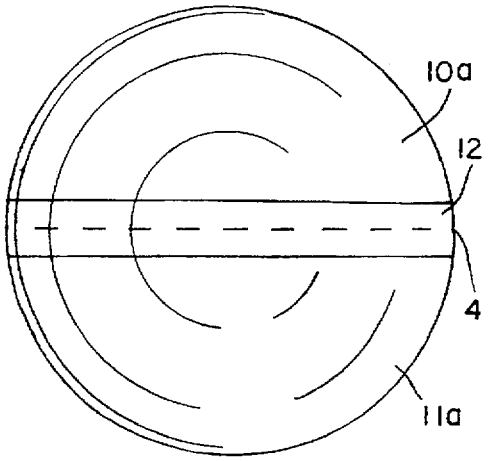
FIG. 3 is a cross sectional view of the inner surface of the present invention gaming ball after assembly taken along lines 1—1 of FIG. 1.

As shown in FIG. 2, the gaming ball is made of two half members 10, 11. Each half member has an inner surface 10*a*, 11*a* and an outer surface 10*b*, 11*b*. FIG. 3 is a cross sectional view of the inner surface of the present invention ball after assembly. Each half is connected together along the inner surfaces 10*a*, 11*a* of each half 10, 11 by a seam member 12. The seam member 12 extends the circumference of the inner surfaces of each half of the ball and weighs at least ⅛ of the total weight of the ball. The seam is made from the same material as the ball or made of adhesive.

Turning to FIG. 4, the bar code 2 is illustrated printed on the gaming ball. The bar code 2 is printed on the outer surface 10*b* of the ball parallel to the seam. By printing the bar code along the seam, the bar code is aligned for reading by a scanner. The weight of the seam provides a leveling means for the leveling the ball during scanning. The ball moves through air tubes to a support diaphragm where the ball is held for scanning. As air controls the gaming ball as it travels through the tube to the support surface, the seam acts as a leveling means to move the ball to the support surface and align the bar code so the digits are perpendicular to the support surface. The level alignment of the bar code permits a quick read for the scanner.

I claim:

1. A gaming ball having:

an inner surface with a seam which weighs more than ⅛ of the weight of the ball, said seam extending around the entire inner circumference of the ball said seam for aligning said ball, on a blowing support surface; and, a bar code printed along the seam on the outside surface of the ball and along said seam.

2. The gaming ball as recited in claim 1 further comprising a number printed on the outside surface of said ball below said bar code.

3. The gaming ball as recited in claim 2 further comprising an indicator pattern printed on the surface directly below said number for making said number clearly visible to the user.

4. A ping pong ball having:

a first half member, said first half member having an inner surface and an outer surface;

a second half member, said second half member having an inner surface and an outer surface;

a seam member, said seam member connecting said first half member and said second half member, said seam member extending along the inner surfaces of said half members and weighing more than ⅛ of the weigh of said ball for aligning said ball on a ball blowing support surface;

a bar code, said bar code printed on said outer surface of said ball along said seam;

a number printed on said surface directly below said bar code; and, a indicator pattern printed below said bar code for making said number clearly visible to said user.

5. The gaming ball as recited in claim 4 further comprising a number printed on the outside surface of said ball below said bar code.

6. The gaming ball as recited in claim 5 further comprising an indicator pattern printed on the surface directly below said number for making said number clearly visible to the user.

* * * * *